United States Patent [19]

Lerner et al.

[11] Patent Number: 4,671,587

[45] Date of Patent: Jun. 9, 1987

[54] CHILD-PROOF OUTLET COVER

[75] Inventors: Michael Lerner, Brookline; Michael Bernstein, Natick; Robert Selame, Brookline, all of Mass.

[73] Assignee: Safety 1st, Inc., Chestnut Hill, Mass.

[21] Appl. No.: 896,422

[22] Filed: Aug. 13, 1986

[51] Int. Cl.[4] ..... H01R 13/44

[52] U.S. Cl. ..... 439/142; 439/135

[58] Field of Search ..... 339/36, 38, 44 R, 44 M

[56] References Cited

U.S. PATENT DOCUMENTS

| | | | |
|---|---|---|---|
| 2,878,456 | 3/1959 | Cormier | 339/44 R |
| 3,387,252 | 6/1968 | Rothweiler | 339/44 R |
| 4,250,349 | 2/1981 | Bennett | 339/44 R |

FOREIGN PATENT DOCUMENTS

| | | | |
|---|---|---|---|
| 1198670 | 7/1970 | United Kingdom | 339/36 |

*Primary Examiner*—Eugene F. Desmond
*Assistant Examiner*—Paula A. Austin
*Attorney, Agent, or Firm*—Wolf, Greenfield & Sacks

[57] ABSTRACT

A child-proof outlet cover includes a base mountable over an electrical outlet faceplate and a pair of caps attached to the base with flexible strips. The caps are retained in the closed position on upstanding walls around openings in the base, which provide access to the outlet sockets. The caps include spaced-apart teeth and the walls include spaced-apart shoulders which engage in the closed position and prevent removal of the cap by a small child. A resilient sheet in the cap biases the teeth and shoulders into engagement. Depression of the cap toward the base followed by rotation are required for cap removal.

11 Claims, 6 Drawing Figures

CHILD-PROOF OUTLET COVER

FIELD OF THE INVENTION

This invention relates to a cover for an electrical outlet, and more particularly, to an outlet cover that can readily be opened by adults but not by children.

BACKGROUND OF THE INVENTION

Children, and particularly very young children, are often attracted, out of natural curiosity, to electrical outlets. Poking a finger or other object into the outlet can result in severe injury due to electrical shock. Various devices have been developed to prevent such accidents. One such device is a flat plastic disk having a pair of integral prongs for insertion into the socket openings. That device, however, is often difficult to remove when one desires to make use of the outlet and is easily misplaced or lost after removal. Moreover, it often can be pried loose and removed by a child, thereby negating its usefulness.

Other outlet covers have been developed for weatherproofing and locking of outlets and for preventing drafts. An outlet cover with caps secured to a faceplate by flexible strips is disclosed in U.S. Pat. No. 4,250,349 issued Feb. 10, 1981 to Bennett. Prior art outlet covers have been expensive and complex in construction or have not provided the desired child-proof features.

It is a general object of the present invention to provide an improved child-proof outlet cover.

It is a further object of the present invention to provide an outlet cover that is easily opened by an adult for use of the outlet.

It is another object of the present invention to provide an outlet cover that cannot be opened by a small child.

It is still another object of the present invention to provide an outlet cover that is inexpensive to manufacture and simple to install and operate.

It is yet another object of the present invention to provide an outlet cover which cannot be lost or misplaced when removed.

It is a further object of the present invention to provide an outlet cover wherein one socket of a dual outlet remains safely covered when the other socket is in use.

SUMMARY OF THE INVENTION

According to the present invention these and other objects and advantages are achieved in a child-proof outlet cover comprising a base having a pair of openings for access to the outlet and a pair of caps for covering the access openings. The base includes upstanding walls surrounding each opening, each wall having a plurality of spaced-apart, laterally extending shoulders near its top. Each cap includes a cover portion for covering the respective opening and a flange having a plurality of spaced-apart, laterally extending teeth for engaging the shoulders when the cover is closed. Each cap further includes resilent means for normally biasing the cap away from the base so that the teeth remain in engagement with the shoulders and for permitting the teeth to be disengaged from the shoulders for removal of the cap when the cap is depressed toward the base and then rotated. The outlet cover further includes a flexible attachment strip between each cap and the base and means for mounting the base to the outlet with the access openings aligned with the respective sockets.

In a preferred embodiment, each of the shoulders includes a tapered surface terminated in an inwardly extending stop surface and each of the teeth includes a tapered surface terminated in an outwardly extending stop surface. The wall and the flange have sufficient resilience to permit the cap to be pressed onto the wall until it snaps into a closed position with the stop surfaces of the teeth and shoulders engaged. It is preferred that the resilient means comprise a resilient sheet retained in the cap by the stop surfaces of the teeth and support means for supporting a central part of the resilient sheet in a parallel, spaced-apart relationship with the cover portion so that an outer edge of the resilient sheet is flexed toward the cover portion when the cap is depressed toward the base. The resilient sheet biases the cap and the base in opposite directions and maintains the teeth in engagement with the shoulders.

BRIEF DESCRIPTION OF THE DRAWINGS

For better understanding of the present invention together with other and further objects and advantages thereof, reference is made to the accompanying drawings which are incorporated herein by reference and in which.

DETAILED DESCRIPTION OF INVENTION

Figure 1:
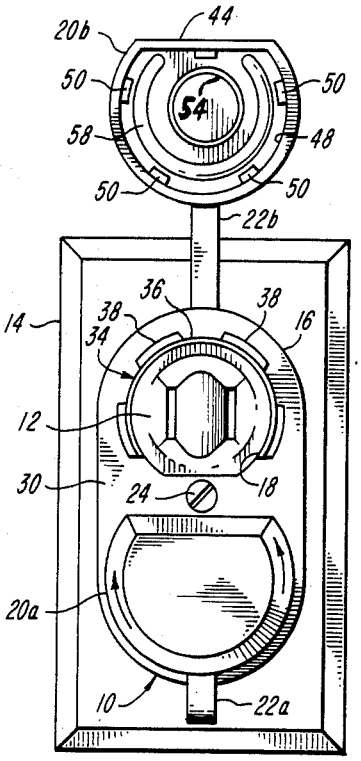
FIG. 1 illustrates a preferred embodiment of the invention mounted on an electrical outlet with one outlet covered and one uncovered.

An outlet cover 10 in accordance with the present invention is shown in FIG. 1 mounted on a conventional two socket electrical outlet which includes a pair of sockets or outlets 12 and a faceplate 14. The outlet cover 10 includes a generally oval base 16 with openings 18 for access to outlets 12 and a pair of caps 20*a*, 20*b* connected to the base 16 by flexible strips 22*a*, 22*b*. Outlet cover 10 is secured over faceplate 14 with a centrally located mounting screw 24. In a preferred embodiment the entire outlet cover 10, including base 16, caps 20*a*, 20*b*, and flexible strips 22*a*, 22*b* is a single molded piece fabricated from polypropylene. In FIG. 1 the outlet cover 10 is shown with cap 20*a* closed over its access opening and cap 20*b* in the open position. The outlet cover 10 is provided with a child-proof feature wherein caps 20*a* and 20*b* are easily closed and opened 18 by adults but which small children find extremely difficult to remove.

Figure 3:
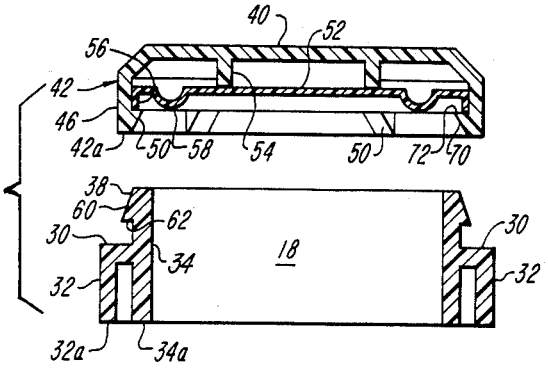
FIG. 3 is a cross sectional view of an outlet cover in accordance with the present invention illustrating the base and cap with the cap removed.
Figure 2:
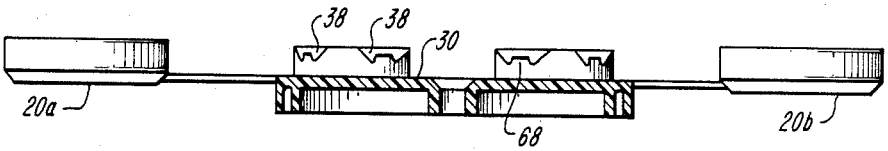
FIG. 2 is an elevation view of the outlet cover of the present invention shown partly in cross section.

The base 16, as shown FIGS. 1–3, includes a front wall 30 of generally oval shape and a rearwardly extending side wall 32 around the periphery of the front wall 30. The front wall 30 and the side wall 32 form an enclosure around the two electrical outlets 12. Access openings 18 extend through the front wall 30 in alignment with outlets 12. A hole 33 is provided through front wall 30 for mounting of the base 16 over the faceplate 14 with screw 24. Upstanding walls 34 substantially surround each of the openings 18 and extend from the surface of the faceplate to above the front wall 30 thereby forming a shell of generally cylindrical shape. Walls 34 include an outer surface 36 provided with a series of outwardly extending shoulders 38 near the top thereof. The shoulders 38 are a part of the child-proof feature described hereinafter. The flexible strips 22*a*, 22*b* are connected to the base 16 at opposite ends of the oval shaped front wall 30. The sidewall 32 and the walls 34 include bottom edges 32*a*, 34*a* respectively which abut against the front of the faceplate 14 in the installed position. The walls 34 are dimensioned to fit around the outside of the outlets 12 which typically extend slightly above the faceplate 14.

Each of the caps 20*a* and 20*b* includes a generally flat cover portion 40 and a peripheral flange 42 surrounding the cover portion 40. The cover portion 40 has a generally circular shape with a flat edge 44 which corresponds to the flat edge of standard outlets 12. The outer surface 46 of the flange 42 may be provided with a series of ridges to facilitate manual gripping of the cap during removal and replacement of the cap. The cover portion 40 and the flange 42 are dimensioned to fit over the wall 34 and safely cover the access opening 18. An inner surface 48 of the flange 42 includes a series of teeth 50 in locations corresponding to those of the shoulders 38. Caps 20*a* and 20*b* further include a generally flat resilient sheet 52 in the area defined by the inner surface 48 of the flange 42. Preferably, the resilient sheet 52 is polyethylene. The resilient sheet 52 is mounted in the cap parallel to the cover portion 40 and retained therein by the inwardly extending teeth 50. An upstanding circular rib 54 extends from the center part of the cover portion 40 in the same direction as the flange 42 and supports the resilient sheet 52 in parallel, spaced-apart relationship with the cover portion 40. The resilient sheet 52 is further provided with a peripheral lip 56 and a raised rib 58 of generally circular shape inward of the periphery for enhancing the resilence thereof. The resilient sheet 52 acts in combination with the teeth 50 and the shoulders 38 to provide the child-proof feature, as described hereinafter.

Figure 4:
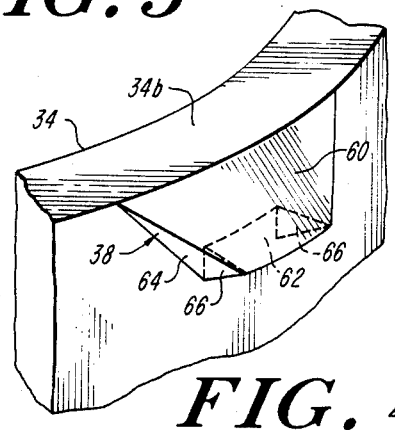
FIG. 4 is an enlarged partial perspective view of the base of the outlet cover illustrating the details of the shoulder.

An enlarged view of a shoulder 38 on the wall 34 is shown in FIG. 4. A surface 60 of the shoulder 38 is tapered outwardly with distance from the top 34*b* of wall 34 toward the front wall 30. The tapered surface 60 is terminated in an inwardly extending stop surface 62. Each of the shoulders 38 further includes side surfaces 64 tapered inwardly toward each other from the top 34*b* of wall 34 and defining projections 66 on opposite sides of and extending below stop surface 62. The projections 66 and the stop surface 62 define a notch 68 in the shoulder 38. In a preferred embodiment, the shoulders 38 are an integral part of the wall 34.

Each of the teeth 50 in the caps 20*a* and 20*b* includes a surface 70 tapered inwardly with distance from edge 42*a* of flange 42 toward cover portion 40. The tapered surface 70 is terminated in an outwardly extending stop surface 72. The teeth 50 have widths which can be engaged in the corresponding notches 68 of shoulders 38. In FIG. 1 it can be seen that the shoulders 38 are circumferentially spaced around the wall 34 and that the teeth 50 are circumferentially spaced around the cap 20*b* with the same spacing.

In use, the cap 20*b* is positioned over the wall 34 as shown in FIG. 3 and is pressed downwardly so that the tapered surfaces 70 of cap 20*b* slide over the tapered surfaces 60 of wall 34. The cap 20*b* and wall 34 each have sufficient resilience so that they are deformed slightly, permitting the tapered surfaces 60 and 70 to slide past each other. The cap 20*b* snaps into place when the stop surfaces 62, 72 engage each other. The engagement of stop surfaces 62, 72 prevents removal of the cap 20*b* except as described below.

Figure 5A:
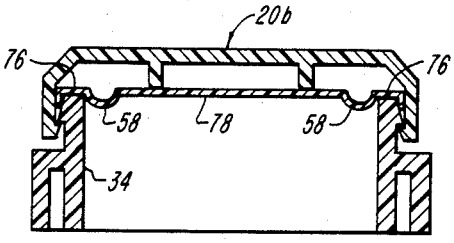
FIGS. 5A and 5B are cross sectional views of the outlet cover illustrating the normal closed position and the depressed position required for removal, respectively.

Referring now to FIG. 5A, the cap 20*b* is shown in the closed position on the wall 34 with the stop surfaces 62, 72 engaged. In this position the cap 20*b* cannot be removed from the wall 34 by pulling outward on it due to the abutment of the stop surfaces 62, 72. The cap 20*b* is prevented from being rotated on the wall 34 by the projections 66 on either side of stop surface 62 on shoulders 38. Furthermore, any tendency of the cap 20*b* to move further inward toward the outlet 12 is prevented by the resilient sheet 52 which rests against circular rib 54 in the cap and the top 34*b* of wall 34 and biases the cap 20*b* outwardly.

Figure 5B:
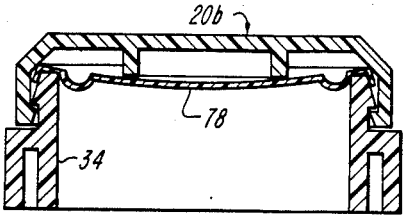

For removal of the cap 20*b* from wall 34, it is necessary to depress the cap 20*b* in the direction of the outlet 12 as shown in FIG. 5B. This causes a deformation of the resilient sheet 52, since its peripheral edge 76 is pushed toward the cover portion 40 of the cap, while the center part 78 of the resilient sheet 52 is held in position by the circular rib 54. Thus, the resilient sheet 52 tends to return the cap 20*b* to the position shown in FIG. 5A as soon as the depressing force is removed. For removal the cap 20*b* must be depressed as shown in FIG. 5B and, after depression it must be rotated until the teeth 50 clear the projections 66. Then, the cap 20*b* can be removed by pulling it outwardly with the teeth 50 passing between the shoulders 38. The required motion of depression followed by rotation while the cap is depressed is difficult for small children to accomplish thereby making the outlet cover essentially child-proof. Depression of the cap only or rotation only is insufficient to remove the cap. However, the cap 20*b* is easily removed by adults familiar with the required motion.

While there has been shown and described what is at present considered the preferred embodiment of the present invention, it will be obvious to those skilled in the art that various changes and modifications may be made therein without departing from the scope of the invention as defined by the appended claims.

What is claimed is:

1. A child-proof outlet cover comprising:

a base having an opening for access to the outlet and a wall extending from said base and substantially surrounding said opening, said wall having a plurality of spaced-apart, laterally extending shoulders near its top;

a cap for attachment to said wall having a cover portion for covering said opening and a flange having a plurality of spaced-apart, laterally extending teeth for engagement with said shoulders when said cover is closed, said cap including resilient means for normally biasing said cap away from said base so that said teeth remain in engagement with said shoulders and for permitting said teeth to be disengaged from said shoulders for removal of said cap when said cap is depressed toward said outlet and then rotated;

a flexible attachment between said cap and said base; and means for mounting said base to said outlet with said access opening aligned with the outlet.

2. An outlet cover as defined in claim 1 wherein said flexible attachment includes a flat strip integrally molded with said cap and said base.

3. An outlet cover as defined in claim 1 wherein each of said shoulders includes a surface tapered outwardly with distance from the top of said wall and terminated in an inwardly extending stop surface, and each of said teeth includes a surface tapered inwardly with distance from the edge of said flange and terminated in an outwardly extending stop surface, said wall and said flange having sufficient resilience to permit said cap to be pressed onto said wall until it snaps into the closed position with the stop surfaces of said teeth engaged with the stop surfaces of said shoulders.

4. An outlet cover as defined in claim 3 wherein each of said shoulders includes downward projections on opposite sides of said stop surfaces to define a notch for receiving one of said teeth, such that said cap must be pressed toward said base until the stop surfaces of said teeth clear said projections and then must be rotated for removal thereof.

5. An outlet cover as defined in claim 1 wherein said flange surrounds said wall when the cover is closed, said shoulders extend outwardly from an outer surface of said wall and said teeth extend inwardly from an inner surface of said flange.

6. An outlet cover as defined in claim 5 wherein said resilient means comprises a resilient sheet retained in said cap by said teeth and support means for supporting a central part of said resilient sheet in a parallel, spaced-apart relationship with said cover portion so that an outer edge of said resilient sheet is flexed toward said cover portion when said cap is pressed on said wall, said resilient sheet biasing said cap and said base in opposite directions and maintaining said teeth in engagement with said shoulders.

7. An outlet cover as defined in claim 6 wherein said support means comprises a support rib extending from the central part of said cover portion in the same direction as said flange.

8. An outlet cover as defined in claim 7 wherein said resilient sheet includes a raised generally circular rib of smaller diameter than said wall for enhancing the resilience thereof.

9. An outlet cover as defined in claim 1 having two openings for access to a conventional electrical outlet and a pair of caps each individually attached to said base with a flexible attachment strip.

10. An outlet cover as defined in claim 9 wherein said mounting means comprises a mounting hole between said access openings for mounting said cover and an outlet faceplate over said outlet with a mounting screw.

11. An outlet cover as defined in claim 10 Wherein said caps, said attachment strips and said base are an integrally molded plastic piece.

* * * * *